US005963989A

United States Patent [19]

Robertson

[11] Patent Number: 5,963,989

[45] Date of Patent: Oct. 12, 1999

[54] SOCCER HEADBAND

[76] Inventor: Donald R. Robertson, 170 W. State St., Pasadena, Calif. 91105

[21] Appl. No.: 09/123,013

[22] Filed: Jul. 27, 1998

[51] Int. Cl.[6] ..... A41D 20/00

[52] U.S. Cl. ..... 2/411; 2/171; 2/425; 2/DIG. 11

[58] Field of Search ..... 2/171, 411, 425, 2/DIG. 11, 209.3, 209.4, 209.5, 209.7, 413, 414, 412

[56] References Cited

U.S. PATENT DOCUMENTS 2,051,714 8/1936 Huntington ..... 2/209.3
4,646,367 3/1987 El Hassen ..... 2/411
4,698,852 10/1987 Romero ..... 2/171
4,910,804 3/1990 Lidgren ..... 2/DIG. 11
4,947,488 8/1990 Ashinoff ..... 2/411
5,640,721 6/1997 Jackson ..... 2/171

*Primary Examiner*—Diana Oleksa
*Attorney, Agent, or Firm*—Joseph E. Mueth

[57] ABSTRACT

A headband to be worn on the head of a soccer player including a padded portion adapted to ride on that area of the head normally used to head a soccer ball.

18 Claims, 4 Drawing Sheets

FIG. 4.
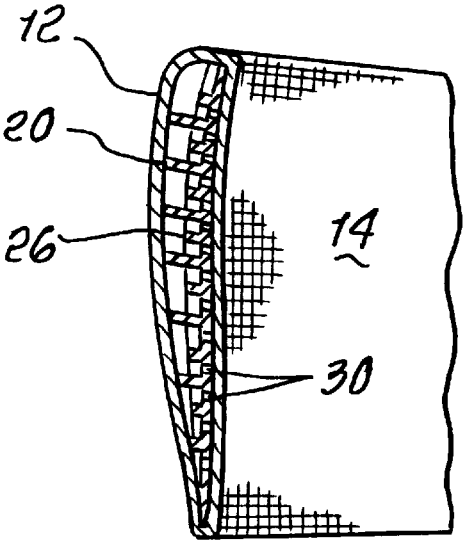
FIG. 5.
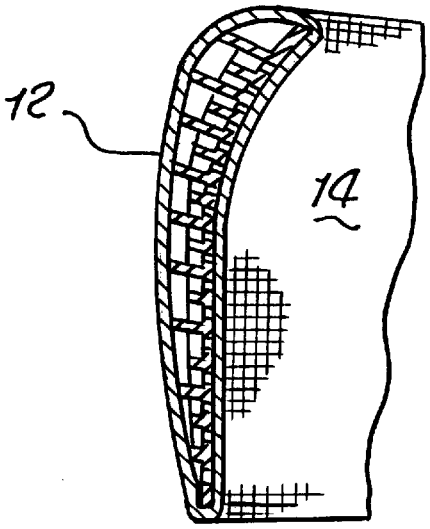
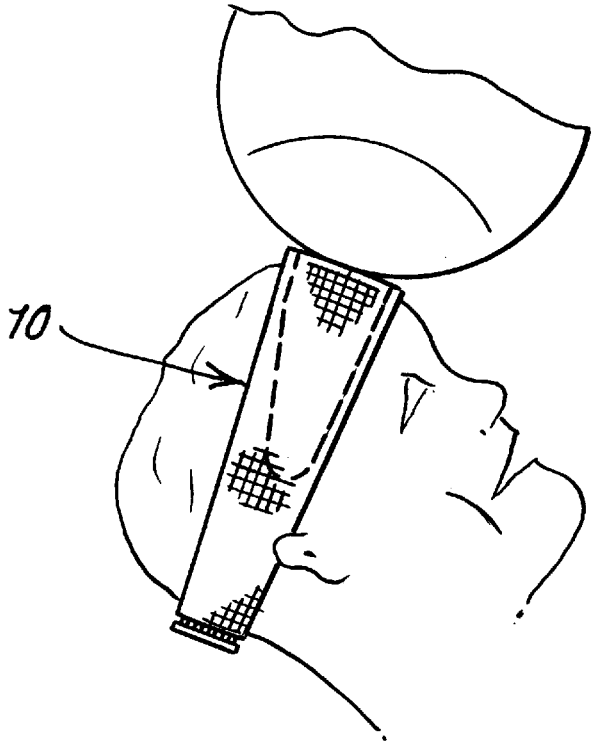
FIG. 6.

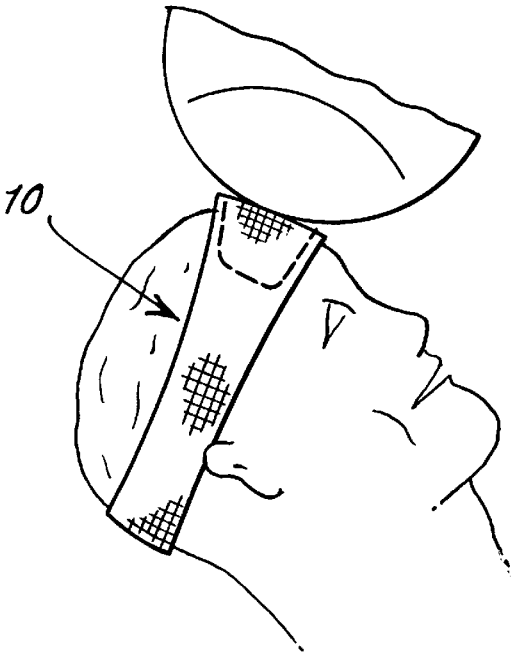
FIG. 7.
FIG. 8.
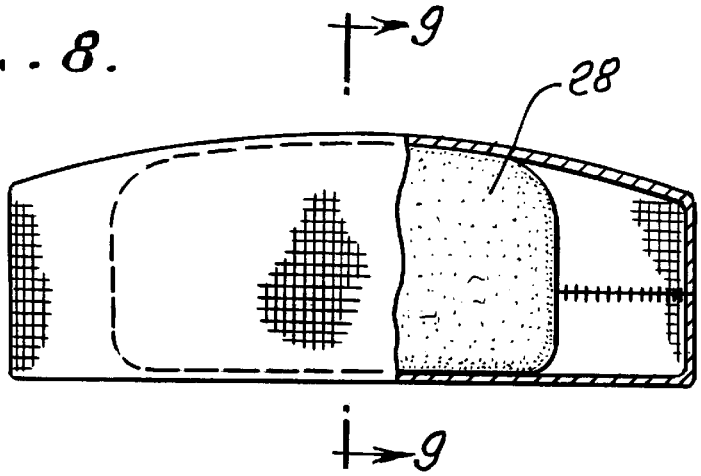
FIG. 9.
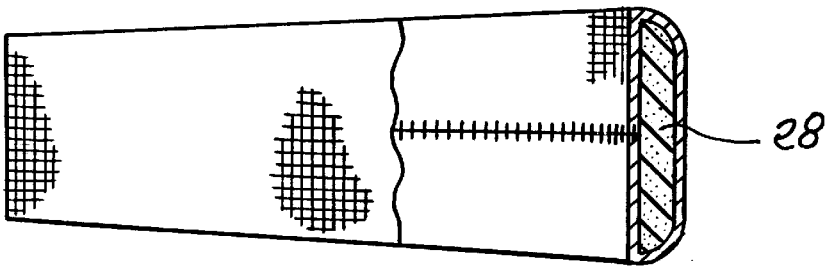

SOCCER HEADBAND

BACKGROUND OF INVENTION

A distinctive feature of the sport of soccer is the use of the head to forcefully direct the ball. The potential for brain and neck injury from many impacts of the head against the soccer ball has been the subject of numerous medical investigations over the past twenty years. Most of these studies have found evidence of physical damage from the accumulative effect of repeatedly heading the ball.

Several studies of former professional soccer players found evidence of neuropsychologic deficits which were attributed to multiple minor impacts while heading the soccer ball, Sortland O, Tysvaer At: Brain damage in former association football players, An evaluation by cerebral computed tomography, *Neuroradiology* 31: 44–48, (1989); Tysvaer A T, Lochen E A: Soccer injuries to the brain, A neuropsychologic study of former soccer players, *American Journal of Sports Medicine* 19: 56–60, (1991); and Tysvaer At, Storli Ov: Soccer injuries to the brain, A neurologic and electroencephalographic study of active football players, *American Journal of Sports Medicine* 17: 573–578, (1989).

A very recent study, using MRI imaging of the brain, found a very high incidence of small brain lesions in active soccer players compared with the same incidence in non-athletes and in American football players. The type of lesions discovered have been associated with "subtle cognitive dysfunctions" in otherwise healthy individuals, T. Autti; L. Sipila; H. Autti; O. Salonen, Brain lesions in players of contact sports, (Research Letters) *The Lancet*, Apr. 19, 1997, v349, n9059, p1144.

Several medical studies have found evidence of accumulative damage to the necks of soccer players, which has also been attributed to heading the soccer ball on a repeated basis, Soppetta C. Vaccario M L: Central cervical cord syndrome after heading a football, *Lancet* 1 (8076): 1269, (1978); and Sortland O, Tysvaer A T, Storli O V: Changes in the cervical spine in association football players, *British Journal of Sports Medicine* 16: 80–84, (1982). Another study finds degeneration in the necks of professional soccer players in the U.S., *The Back Letter*, September 1997, v12, p99.

As a result of these and other medical findings, there has been a growing concern about the possible negative effects of heading the soccer ball and widespread discussions on the possible need for protective headgear of some sort.

In general, protective headgear of the known types are not readily adaptable to the game of soccer. Elaborate helmets do not comport with Soccer's tradition of toughness and are deemed unacceptable. In addition, any protective headgear must meet at least three criteria, viz, the headgear must be aesthetically acceptable, provide impact protection while at the same time maintaining the desired rebound of the soccer ball when headed by the wearer.

The invention presented here is intended to fill this real and perceived need within the sport of soccer.

SUMMARY OF INVENTION

Briefly, this invention comprises a headband adapted to be worn on the head of a soccer player to protect against injury including a padded portion adapted to ride on that area of the head normally used to head a soccer ball.

More preferably the invention comprises a headband to be worn on the head of a soccer player to protect against injury including a padded portion adapted to ride on that area of the head normally used to head a soccer ball wherein the padded portion is a grid-like shock absorbing structure composed of a resilient elastomeric material, preferably thicker at its upper extremity and also thicker in the center portion, gradually thinning out in the lateral dimension.

DESCRIPTION OF PREFERRED EMBODIMENTS

Turning to the drawings.

FIG. 4 is a sectional view taken along the line 4—4 in FIG. 2.

FIG. 5 is a sectional view similar to FIG. 4 showing an alternate embodiment in which the surface of the padded portion is curved to conform to the shape of the human head.

FIG. 6 shows, in a generally side view, an embodiment of the headband wherein the padded portion terminates in proximity to the temples and further shows the use of the headband in heading a soccer ball.

FIG. 7 is similar to FIG. 6 with the modification that the padded portion is shorter in the lateral dimension.

FIG. 8 is a front view, in partial breakaway, of an embodiment of the headband similar to FIG. 7.

FIG. 9 is a partial section taken along the line 9—9 in FIG. 8.

Figure 1:
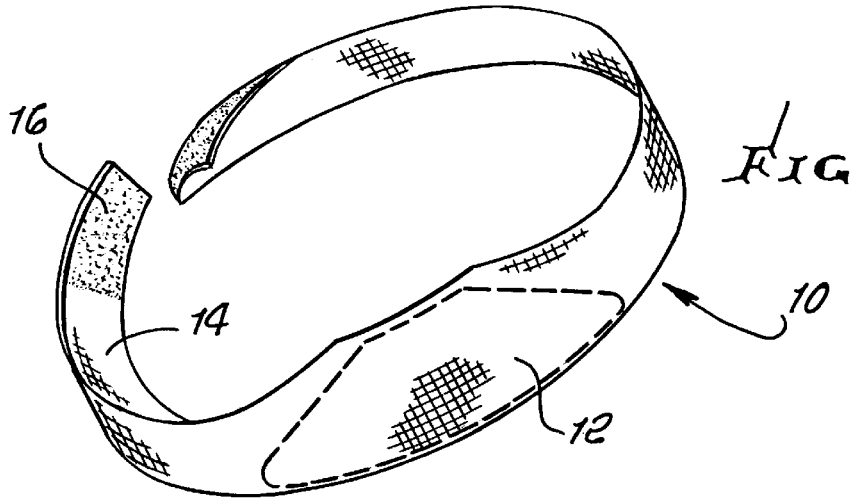
FIG. 1 is a perspective view of one embodiment of the headband of this invention.
Figure 2:
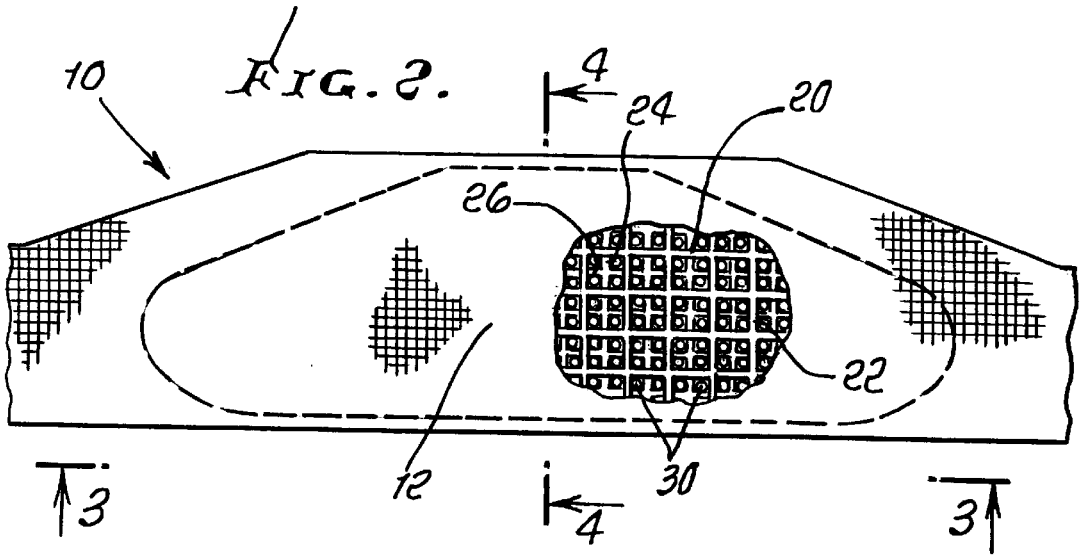
FIG. 2 is an enlarged frontal view, in partial breakaway, shoring a preferred embodiment of the padded portion of the headband of FIG. 1.
Figure 3:
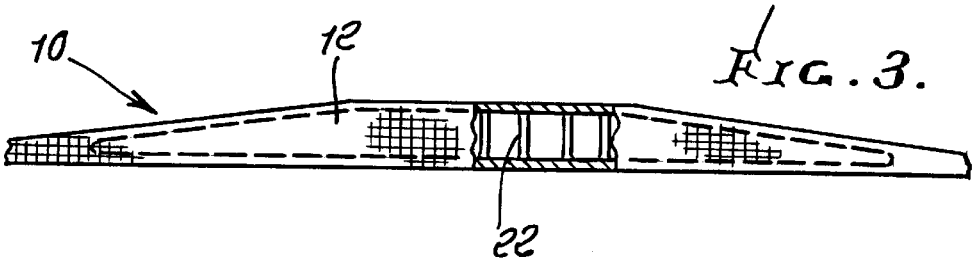
FIG. 3 is a section taken along line 3—3 in FIG. 2.
Figure 10:
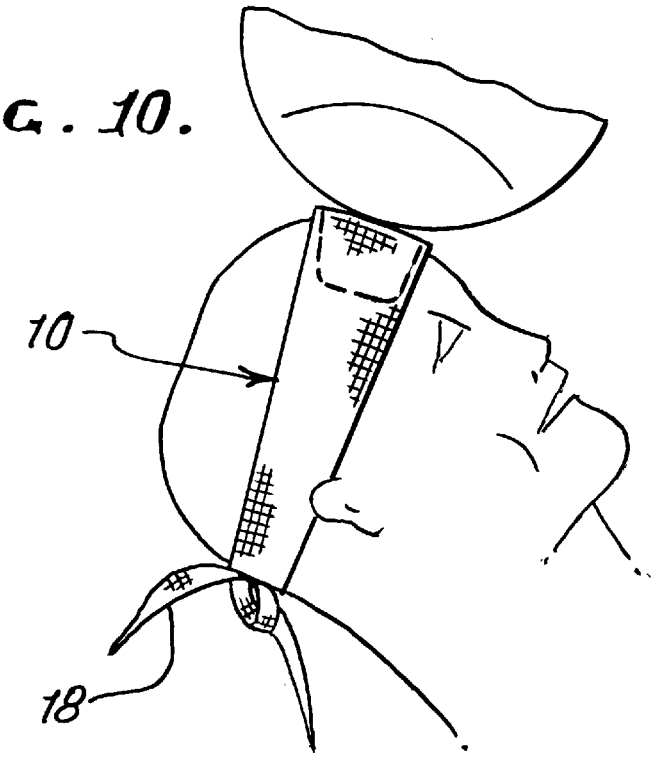
FIG. 10 shows another embodiment of the headband of this invention in the form of a bandanna.

Turning to the drawings in more detail, the headband, generally indicated by reference numeral 10, can take the form of a resilient elastomeric pad portion 12 adapted to ride on the soccer players head in the location normally used in heading the ball. The balance of the headband is usually an outer enclosure 14 extending around the head to the rear where the ends of the enclosure are provided with Velcro or other similar fastening means 16. Another configuration of the headband of this invention is a bandanna 18 tied at the back of the head as shown in FIGS. 9 and 10. The headband can also be in the form of a closed expandable elastic band in which case closures, fasteners or tying is unnecessary. The enclosure 14 is normally made of some moisture absorbent material such as cotton, which can, for example, be in the form of terrycloth.

Any desired color, insignia or team identifying dress, symbols, or other adornment can be provided on headband 10 to produce an acceptable aesthetic appearance. The headband can be adorned so as to be unobtrusive and part of the remainder of a team uniform. For example, the only existing pads normally worn when playing Soccer are shinguards, which are worn beneath long uniform socks. The headband can also carry a commercial logo.

It is also to be understood that the headband of this invention can be worn by soccer fans as street dress for the purpose of personal adornment or to signify personal affiliation or loyalty to some specific soccer team. Thus, the invention is not limited to actual use in playing soccer.

The preferred resilient pad material 12, as best shown in the two embodiments of FIGS. 4 and 5, is based on the cushioning material of U.S. Pat. No. 5,172,494. This resilient pad 12 includes primary shock absorbing means comprising first ribs 20 and second ribs 22 intersecting and interconnecting to form a plurality of first sections having a predetermined first height which will absorb initial shock loads imposed by the impact of the soccer ball by deflection and deformation of said primary shock absorbing means. The resilient pad 12 also has a secondary shock absorbing means comprising third ribs 24 and fourth ribs 26 intersecting and interconnected to one another and connected to at least selected of the first sections, the third and fourth ribs having a predetermined second height less than the first height of the first and second ribs. The secondary shock absorbing means are resilient members providing resistance to loads whereby the primary and secondary shock absorbing means cooperate to absorb shock forces and exhibit a non-linear force displacement behavior at predetermined load levels. In general, the primary and secondary shock absorbing members are defined by longer and shorter ribs extending longitudinal and transversely at right angles to each other along the outer surface of resilient pad 12 in an open grid-like pattern on the side intended to impact the soccer ball. The opposed surface is closed and planar and carries the grid-like pattern.

The pad 12 can be flat on both of the main opposed surfaces as shown in FIG. 4. However, preferably, the closed surface which abuts the players head is curved to generally conform to the curvature of the head in the area used for heading a soccer ball, as shown in FIG. 5. In addition, the pad 12 is preferably thicker at its top to provide more thickness of padding in proximity to the junction of the forehead and the scalp.

Figure 11:
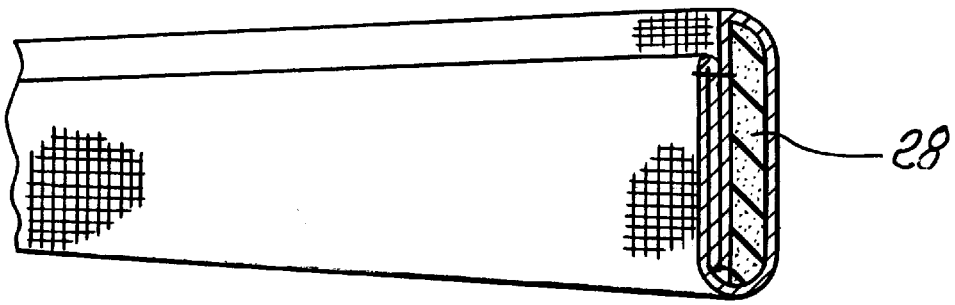
FIG. 11 shows a partial sectional view through the bandanna embodiment of FIG. 10.

Other resilient pad materials are also useful in the practice of this invention which comprehends all resilient materials which mitigate the effect of impact on the players head and neck while at the same time maintaining adequate rebound of the ball in a way which does not alter game play. Thus, a structurally homogenous resilient pad 28 may be used as shown in FIGS. 8, 9 and 11.

The resilient pad material 12 is preferably modified by the provision of holes 30 therethrough to allow for cooling airflow and the release of moisture due to sweating.

The pad 12 can vary in its lateral dimension. It is essential that the pad at least cover the area of the head most commonly used for heading a soccer ball, FIGS. 7 to 11. The pad 12 may also wrap around the head and terminate in proximity to the temples, as shown in FIG. 6.

The following claims are intended to particularly point out and claims the invention.

I claim:

1. A headband adapted to be worn on the head of a soccer player to protect against injury including a resilient padded portion adapted to ride on that area of the head normally used to head a soccer ball, wherein said padded portion has a surface adapted generally to abut the head, said surface being vertically curved to generally conform to the curvature of the head in the area used for heading a soccer ball, said area including the front of the forehead and extending vertically up to and including the area in proximity to the junction of the forehead and the scalp, said resilient pad being composed of a material which mitigates the effect on impact on the players head and neck while at the same time maintaining adequate rebound of the ball in a way which does not alter game play.

2. The headband of claim 1 in the form of a bandanna adapted to be tied at the rear of the head.

3. The headband of claim 1 in the form of an elastic band adapted to be snugly received around the head.

4. The headband of claim 1 in the form which includes two complementary fastener portions adapted to be joined or adhered at the rear of the head.

5. The headband of claim 1 wherein the padded portion is covered with a moisture absorbing material at least on that side of the padded portion adapted to ride against the head.

6. The headband of claim 1 wherein the padded portion is tightly enclosed by a moisture absorbing material.

7. The headband of claim 1 wherein the padded portion is adapted to extend around the front of the head and terminate in proximity to the temples.

8. The headband of claim 1 wherein the padded portion is of a width approximating the width of the forehead.

9. The headband of claim 1 wherein the padded portion is composed of an elastomeric polymeric material.

10. The headband of claim 1 wherein the padded portion is comprised of a resilient body member which includes primary shock absorbing means extending from the outer surface of the body member, said primary shock absorbing means comprising first and second ribs intersecting and interconnecting to form a plurality of first sections having a predetermined first height which will absorb initial shock loads imposed by the impact of a soccer ball by deflection and deformation of said primary shock absorbing means; and secondary shock absorbing means extending from the outer surface of the body, said secondary shock absorbing means comprising third and fourth ribs intersecting and interconnected to one another and connected to at least selected of said first sections, said third and fourth ribs having a predetermined second height less than the first height of said first and second ribs, said secondary shock absorbing means being resilient members providing resistance to loads whereby said primary and secondary shock absorbing means cooperate to absorb shock forces and exhibit a non-linear force displacement behavior at predetermined load levels.

11. The headband of claim 10 wherein the resilient body member is provided with air holes therethrough to permit the flow of cooling air and the escape of moisture.

12. The headband of claim 1 wherein the headband is adorned by a material to render it aesthetically compatible with the balance of a soccer players attire.

13. The headband of claim 1 wherein the padded portion is thicker at its upper extremity than at its lower extremity.

14. The headband of claim 1 wherein the padded portion is thicker at its center and thinner at its side extremities.

15. A headband adapted to be worn on the head of a soccer player to protect against injury including a padded portion adapted to ride on that area of the head normally used to head a soccer ball, wherein the padded portion is comprised of a resilient body member which includes primary shock absorbing means extending from the outer surface of the body member, said primary shock absorbing means comprising first and second ribs intersecting and interconnecting to form a plurality of first sections having a predetermined first height which will absorb initial shock loads imposed by the impact of a soccer ball by deflection and deformation of said primary shock absorbing means; and secondary shock absorbing means extending from the outer surface of the body, said secondary shock absorbing means comprising third and fourth ribs intersecting and interconnected to one another and connected to at least selected of said first sections, said third and fourth ribs having a predetermined second height less than the first height of said first and second ribs, said secondary shock absorbing means being resilient members providing resistance to loads whereby said primary and secondary shock absorbing means cooperate to absorb shock forces and exhibit a non-linear force displacement behavior at predetermined load levels.

16. A headband adapted to be worn on the head of a soccer player to protect against injury including a padded portion adapted to ride on that area of the head normally used to head a soccer ball, wherein the padded portion is thicker at its upper extremity than at the lower extremity.

17. A headband adapted to be worn on the head of a soccer player to protect against injury including a padded portion adapted to ride on that area of the head normally used to head a soccer ball, wherein the padded portion is thicker at its center and thinner at its side extremities.

18. A headband adapted to be worn on the head of a soccer player to protect against injury including a padded portion adapted to ride on that area of the head normally used to head a soccer ball, wherein said padded portion comprises a resilient, elastomeric polymeric body member, said resilient body member having air holes therethrough to permit the flow of cooling air and the escape of moisture.

* * * * *